US010807272B2

(12) United States Patent
Schmid

(10) Patent No.: US 10,807,272 B2
(45) Date of Patent: Oct. 20, 2020

(54) DEVICE AND METHOD FOR COATING WORKPIECES

(71) Applicant: HOMAG HOLZBEARBEITUNGSSYSTEME AG, Schopfloch (DE)

(72) Inventor: Johannes Schmid, Starzach (DE)

(73) Assignee: HOMAG Holzbearbeitungssysteme AG, Schopfloch (DE)

( * ) Notice: Subject to any disclaimer, the term of this patent is extended or adjusted under 35 U.S.C. 154(b) by 535 days.

(21) Appl. No.: 15/387,849

(22) Filed: Dec. 22, 2016

(65) Prior Publication Data

US 2017/0129130 A1 May 11, 2017

Related U.S. Application Data

(62) Division of application No. 13/522,731, filed as application No. PCT/EP2011/050450 on Jan. 14, 2011.

(30) Foreign Application Priority Data

Jan. 18, 2010 (EP) ..... 10150952

(51) Int. Cl.
*B27D 5/00* (2006.01)

(52) U.S. Cl.
CPC ..... *B27D 5/003* (2013.01); *Y10T 156/10* (2015.01); *Y10T 156/1744* (2015.01)

(58) Field of Classification Search
CPC ..... B27D 5/003
(Continued)

(56) References Cited

U.S. PATENT DOCUMENTS 6,451,152 B1 * 9/2002 Holmes ..... B23K 26/034 156/173
2011/0086237 A1 * 4/2011 Chambers ..... B29C 65/1412 428/516

(Continued)

FOREIGN PATENT DOCUMENTS

DE 20-2009-009253 * 12/2009
EP 1800813 A2 * 6/2007 ..... B27D 1/00
WO WO 2009-103981 * 8/2009

*Primary Examiner* — Michael N Orlando
*Assistant Examiner* — Elizabeth Bradford
(74) *Attorney, Agent, or Firm* — Scott R. Cox

(57) ABSTRACT

The invention relates to a device (1) for coating workpieces (2), preferably consisting of wood, wood-based materials, plastics material or the like at least in sections, comprising a feed device (10) for feeding a coating material (12), a pressing unit (20) for pressing the coating material (12) against a surface (2*a*) of a workpiece (2), a conveyor device (4) for bringing about a relative motion between the pressing device (20) and the respective workpiece (2), an energy source (30) for applying energy onto the coating material (12) and/or the workpiece (2), and a control device (50) for controlling at least the energy source (30). The device according to the invention is characterized in that the energy source (30) comprises at least two energy generating sections (30', 30"), wherein the control device (50) is equipped to operate at least two energy generating sections (30', 30") at least intermittently with at least one operating parameter, the parameters being different from each other, or the energy generating sections are different from each other.

11 Claims, 2 Drawing Sheets

(58) Field of Classification Search
USPC ..... 156/272.2
See application file for complete search history.

(56) References Cited

U.S. PATENT DOCUMENTS

| | | | | |
|---|---|---|---|---|
| 2011/0183122 | A1* | 7/2011 | Schumacher ..... | B27D 5/003<br>428/192 |
| 2012/0058279 | A1 | 3/2012 | Schmid | |
| 2016/0221248 | A1 | 8/2016 | Compera et al. | |

* cited by examiner

DEVICE AND METHOD FOR COATING WORKPIECES

CROSS-REFERENCE TO RELATED APPLICATIONS

This application is a divisional application based on U.S. application Ser. No. 13/522,731, filed Jul. 18, 2012, which was filed as a 371 U.S. National Stage of International Application No. PCT/EP2011/050450, filed Jan. 14, 2011, and claims priority to European patent application no. 10 150 952.9, filed Jan. 18, 2010, the disclosures of which are herein incorporated by reference in their entirety.

TECHNICAL FIELD

The invention relates to a device for coating workpieces which preferably consist of wood, wood-based materials, plastics material or the like at least in sections.

PRIOR ART

In the field of the furniture and structural element industry, for example, workpieces are frequently provided on their surface with a coating material, for example an edging. The application of the coating material to the workpieces is frequently carried out by means of a suitable hot-melt adhesive, which is applied, for example, in the hot, molten state to the edging or to the workpiece. Alternatively, it is also possible to heat an edging pre-coated with hot-melt adhesive by means of a hot-air blower and thus bring the hot-melt adhesive to the desired melting temperature.

In addition, DE 10 2006 056 010 discloses a coating method of the type mentioned at the beginning in which an adhesive agent provided on the coating material or on the workpiece is heated and activated using a laser. This method has proved to be efficient because the adhesive agent can purposively be heated and activated.

However, there is further potential for improvement in the coating of components in that the joint between the coating material and the workpiece should be as invisible as possible. To this end, the joint between the coating material and the workpiece should be as thin as possible, or a functional layer (which may also be part of the coating material or of the workpiece) present at the site of the join should be impaired as little as possible in its appearance. At the same time, however, the join should have sufficient strength so that the coating material adheres securely to the workpiece.

DESCRIPTION OF THE INVENTION

Accordingly, it is an object of the invention to provide a device and a method of the type mentioned at the beginning which permit a connection between the coating material and the workpiece that is visible to the smallest possible extent and at the same time is sufficiently strong.

This object is achieved according to the invention by a device and a method disclosed herein. Particularly preferred further developments of the invention are indicated in the dependent claims.

The invention is based on the finding that the adhesive potential of the adhesive agent or functional layers used is frequently not fully utilized. In order to achieve improved utilization of the adhesive potential, it is provided according to the invention that, in a device of the generic type, the energy source has at least two energy generating sections, the control device being arranged to operate at least two energy generating sections at least intermittently with at least one operating parameter that is different from any other.

In this manner, the bandwidth of the activation of the adhesive agent, or of the functional layer, can be markedly widened so that it is possible to work with a thinner adhesive agent layer, or less impairment of the functional layer, while the strength of the join is undiminished. There is accordingly obtained an improved appearance of a coated workpiece and possibly even increased strength of the join.

The inventors have additionally found that the provision according to the invention of at least two energy generating sections which can be operated with at least one operating parameter that is different from any other also results in improved adaptability of the device according to the invention to changing operating conditions. For example, it is possible with the device according to the invention to switch more easily between different coating materials, adhesive agents or functional layers and/or workpieces. This aspect is likewise of great importance in view of ever increasing, individual customer requirements.

Although it will in many cases be advantageous within the context of the present invention to work with at least two energy generating sections of the same type, it is provided as an alternative according to the invention that at least two different energy generating sections are provided. In this case, it may be that the two different energy generating sections do not have a common operating parameter at all but are operated in a fundamentally different manner. The differentiation of the energy generating sections allows the above-described effects which can be achieved by a differentiation of the operating parameters to be even more marked. For example, the material that is to be activated (or rendered adhesive) can first be prepared by means of a first energy generating section, while the actual activation of the material does not take place until a second, downstream step by means of the second (or further) energy generating section. As a result, the adhesive potential of the material to be activated can be utilized more fully, as described above, so that a visually more attractive appearance can be achieved while the strength of the join remains the same.

Within the context of the present invention, the energy source can be constructed with a wide variety of types and number of energy generating sections, wherein the term "energy" is to be interpreted in a broad sense within the context of the present invention. According to a further development of the invention, however, it is provided that at least one energy generating section is chosen from the group consisting of laser generating section, infra-red generating section, ultrasound generating section, magnetic field generating section, microwave generating section, plasma generating section and gassing section. In the course of the tests carried out by the inventors, these energy generating sections have been found to be particularly suitable for joining coating materials to workpieces.

The above list clearly shows that, in addition to conventional energy sources, there are also suitable energy generating sections which apply energy to the coating material by, for example, a chemical reaction, such as, for example, a gassing source. It is also to be noted in this context that the energy generating section in question on the one hand can activate an agent that is already present as adhesive agent and on the other hand can make an agent that does not in itself serve as an adhesive agent into an adhesive agent by subjecting it to energy, by a chemical reaction or the like.

Each of the mentioned energy generating sections has its specific advantages. For example, a laser permits particularly target-oriented and rapid working, while infra-red and plasma sources allow wide-gauge operation and a good depth action. Energy generating sections with ultrasound, magnetic field and microwave work in a contact-free manner and can introduce energy into the process even while the coating material is being pressed on. A magnetic field in particular has a good depth action. An energy source based on gassing is particularly suitable for forming a substance which has adhesive properties by action on and reaction with the coating material.

The operating parameters of the energy generating sections, which according to the invention are set differently in the case of at least two energy generating sections, can be fixed in different ways. According to a further development of the invention, however, it is provided that the operating parameters which can be set independently of one another are chosen from the group consisting of energy intensity, energy direction and energy generation pattern over time, in particular also the time at which an energy generating section is switched on or off. By means of these parameters, the activation of the adhesive agent or of the functional layer can be increased particularly effectively. For example, it has been shown in the activation of plastics materials that different molecule groups are activated by a differentiation of the energy intensities so that, overall, a larger proportion of the material to be activated can be addressed. This can apply correspondingly in respect of the direction of the energy input, for example in that different molecule groups of the material to be activated are addressed according to the direction of energy input.

By a differentiation of the energy generation pattern over time, further effects can also be achieved in addition to the effects mentioned above, for example by purposively subjecting specific regions of the material to be activated to specific operating parameters, which are changed for other regions of the material to be activated, so that an optimum join is achieved. For example, it is possible to work with different operating parameters in the edge regions of the join than in core regions. Finally, differentiated switching on or off of individual or a plurality of energy generating sections allows an optimum join to be achieved.

According to a further development of the invention, a particularly advantageous combination of energy generating sections is present when at least two laser generating sections are provided. Laser generating sections offer a rapid response behaviour, high variability, high precision and numerous further advantages in the activation of joining materials. In addition, the combination of at least two laser generating sections, which are operated according to the invention with at least one operating parameter that is different from any other, permits optimum utilization of the adhesive potential of the joining material so that an attractive appearance and high durability of the join are obtained with optimum strength of the join.

According to a further development of the invention, the provision of at least two laser generating sections can be achieved by providing at least two laser generating sections as separate bars of a laser. There is obtained as a result a simple construction of the device according to the invention, which can easily be controlled.

Alternatively or in addition, it is provided according to a further development of the invention that at least two laser generating sections are provided as separate lasers. This opens up the possibility of spreading the operating parameters widely, as required, and optionally also working with different laser functioning principles (e.g. diode laser, $CO_2$ laser, etc.). The advantages described above can be achieved by such combinations in dependence on the coating material, the material of the workpiece and the adhesive material.

According to a further development of the invention, it is further provided that the control device is arranged to operate at least two laser generating sections with different laser powers and/or laser wavelengths. By staggering these operating parameters, the bandwidth of the material activation can be increased in particular in the case of plastics materials that are to be activated. This can be explained as follows: different laser powers and laser wavelengths address different molecule regions of the material, so that an improved and broadened activation of the material is obtained. A substantial contribution is hereby made to achieving the underlying object.

Although the at least two energy generating sections can in principle act on the material to be activated independently of one another, it is provided according to a further development of the invention that at least two energy generating sections are so arranged that their energy application to the coating material and/or to the workpiece overlaps at least in sections. The interaction of the at least one different operating parameter of the at least two energy generating sections can thereby be used particularly markedly to achieve the underlying object.

Alternatively or in addition, it is provided according to a further development of the invention that the control device is arranged to change at least one operating parameter in the course of a relative movement between the energy source and the coating material or the workpiece. In this manner, a differentiation of the join in different regions can purposively be achieved, for example in order to make the edges of the join visually attractive or even water-tight, while lesser demands are fulfilled in the inner region of the join. Likewise, the differentiation of the operating parameters in terms of time/space enables different overlap effects to be achieved, which permit the advantages already described above in terms of activation of the material in question.

According to a further development of the invention it is additionally provided that the device has a measuring device, in particular a pyrometer, for measuring the amount of energy applied to the coating material and/or to the workpiece by the energy source. The operating parameters can thereby be adjusted particularly precisely to the materials to be processed and the respective boundary conditions, so that an optimum joining result is obtained. It is likewise possible using the measuring device to "calibrate" the device as a whole beforehand in respect of the materials that are to be processed and/or in respect of the other boundary conditions, in order subsequently to use the energy generating sections without operating the measuring device or operating it only occasionally. However, it is likewise possible to carry out by means of the measuring device continuous detection of the amount of energy applied, for example also within the scope of quality control.

The measuring device can be provided either as a separate component or integrated into the energy source (or into one or more energy generating sections) and can be linked into the process via a lens and/or mirror system.

The method according to the invention for coating workpieces using the device according to the invention disclosed herein. With this method, the above-described advantages of the device according to the invention can be realized particularly markedly.

DETAILED DESCRIPTION OF PREFERRED EMBODIMENTS

Preferred embodiments of the present invention are described in detail below with reference to the accompanying drawings.

Figure 1:
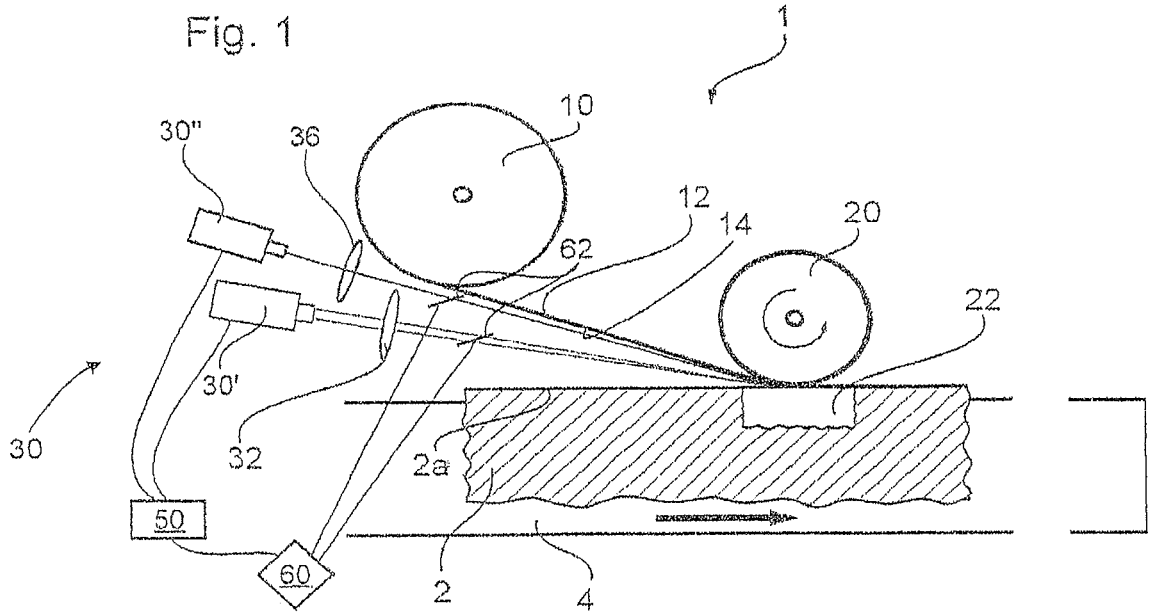
FIG. 1 shows schematically a top view of a coating device 1 as a preferred embodiment of the present invention.

A coating device 1 for coating workpieces 2 as a preferred embodiment of the present invention is shown schematically in a top view in FIG. 1. In the present embodiment, the coating device 1 is used to coat workpieces 2 in sheet form, which consist of wood, wood-based materials, plastics material or the like at least in sections, as are nowadays used, for example, in the field of the furniture and structural element industry. They can be a wide variety of workpieces such as, for example, solid wood or chipboard sheets, lightweight building boards, sandwich panels, skirting boards, profiles for the sheathing of profiles, etc. It is to be noted, however, that the present invention is not limited to such workpieces.

The coating device 1 first comprises a conveyor device 4, which in the present embodiment is in the form of a continuous conveyor device, for example in the form of a roller conveyor, belt conveyor or the like. The conveyor device 4 serves to convey the workpieces 2 in a direction of passage (from left to right in FIG. 1). Alternatively, however, the invention can also be used in so-called stationary machines, in which the workpieces are stationary and processing units are moved. Combinations of these machine concepts are also possible.

Next to the conveyor device 4 there is arranged a feed device 10 for feeding a coating material 12, it being possible for the coating material to be, for example, an edging material for a narrow face of the workpiece or a cover material for a broad face or any other surface of the workpiece 2. The feed device 10 contains a supply of coating material 12, which can consist of a wide variety of materials, such as, for example, plastics material, veneer, paper, cardboard, metal, etc. and various combinations thereof. The coating material can be provided in roll form (optionally in a cassette), for example, or in the form of single sections.

In the present embodiment according to FIG. 1, however, it is a coating material that contains an integral or discrete layer 14 which develops adhesive properties by the supply of energy. Such an integral coating material can be formed, for example, by a plastics material which contains a layer 14 which develops adhesive properties by the supply of energy. When a discrete layer 14 is provided, the remainder of the coating material can in principle consist of any desired material. In any case, the discrete layer 14 is arranged on the side of the coating material 12 that faces the workpiece 2.

The feed device 10 feeds the coating material 12 to a pressing device 20 for pressing the coating material 12 onto a surface 2*a* of the workpiece 2. In the present embodiment, the pressing device 20 is a pressing roller (instead of a pressing roller it is also possible to use, for example, belts, shoes or the like), which rolls over the surface 2*a* of the workpiece 2 and thus presses the coating material 12 onto the surface 2*a* of the workpiece 2.

The coating device 1 further comprises an energy source 30 for applying energy to the adhesive agent or agent that can be rendered adhesive 14. In the present embodiment, the energy source has two energy generating sections 30' and 30", which in the present embodiment are formed by lasers.

Within the context of the present invention, a wide variety of devices come into consideration as alternatives for each of the energy generating sections 30' and 30", such as, for example, laser, infra-red source, ultrasound source, magnetic field source, microwave source, plasma source, gassing source, etc. All these energy generating sections provide energy in directed form and direct it at the adhesive agent or agent that can be rendered adhesive 14, which is fed as an integral or discrete part of the coating material 12. This bundled, or directed, energy is shown in FIG. 1 by a line emanating from each of the energy generating sections 30' and 30". The energy passes through a focusing device 32 or 36, which is arranged to direct the energy provided by the energy generating sections 30' and 30" onto selected regions of the adhesive agent 14 to be activated or produced.

In the simplest case, the focusing device 32 can be a lens. However, it is to be noted that different focusing devices 32 can be used according to the energy generating section 30' or 30", it being possible for the focusing device in each case to be arranged to adjust the scatter width and optionally also the intensity of the applied energy. In this manner, the focusing device 32 directs the energy provided by the energy source 30 into the region immediately upstream of a pressing region 22 in which the coating material 12 is pressed onto the surface 2*a* of the workpiece 2.

The operation of the energy generating sections 30' and 30" and also of the focusing device 32, 36 is controlled by a control device 50, the control device in particular also controlling the operating parameters of the energy generating sections 30' and 30". These operating parameters can be, for example, the energy intensity, the energy direction and the energy generation pattern over time, in particular also the time at which an energy generating section 30', 30" is switched on or off. For the lasers 30' and 30" shown by way of example in FIG. 1, the control device 50 can control as operating parameter in particular the laser power and/or the laser wavelength in each case.

According to the invention, the operating parameters are controlled by operating the energy generating sections at least intermittently with at least one operating parameter that is different from any other. For example, the laser 30' can be operated with a different wavelength than the laser 30". In this manner, improved activation of the layer 14 is achieved because the different wavelengths each address different molecule groups of the material. Similar effects can also be achieved by differentiating other operating parameters, such as, for example, the laser power, etc.

As an alternative to this differentiation of at least one operating parameter in the case of energy generating sections of the same type, it is also possible within the context of the invention to use energy generating sections 30', 30" of different types, as have been outlined above. Improved activation of the layer 14 can also be achieved by this differentiation because the different mechanisms of action of the energy generating sections of different types can, for example, address different molecule groups of the material.

In any case, the operating parameters of the energy generating sections should be matched to the properties and dimensions of the adhesive agent or agent that can be rendered adhesive 14 as well as to the relative speed between the energy source 30 and the adhesive agent 14. Against this background, the control device 50 can also evaluate information from sensors which monitor the operation of the coating device, for example sensors which are arranged in the region of the pressing region 22 and detect, for example, the temperature of the applied coating material 12.

To that end, the device 1 in the present embodiment further has one or more pyrometer(s) 60 which is/are integrated into the beam path of the lasers 30', 30" via half-mirrors 62. Alternatively, a pyrometer or other suitable measuring device can also be integrated into the energy generating section. By means of the pyrometer, the heating and accordingly the actual energy input into the material 14 can be measured. The measurements can be taken continuously or at intervals. It is likewise possible to determine the energy input in a preliminary step and "calibrate" the machine on that basis.

On the basis of this information, the control device 50 can fix the operating parameters of the energy generating sections 30', 30" and optionally also control the focusing device 32, 36 or other parts of the device.

In the present embodiment, the focusing device 32 is arranged to oscillate if required, for example in a direction perpendicular to the plane of the drawing in FIG. 1. An oscillating movement is understood as being a vibration with a frequency of, for example, at least 10 Hz (e.g. 50 Hz). The control device ensures that the focusing device oscillates more quickly, the quicker the relative movement in relation to the workpiece 2.

In the present embodiment, the focusing device 32 can also be displaceable together with the energy source 30, namely in a direction transverse to the direction of passage of the feed device 4. This is particularly advantageous for coating operations over a large surface area, such as, for example, for the coating of the broad faces of workpieces.

Figure 2:
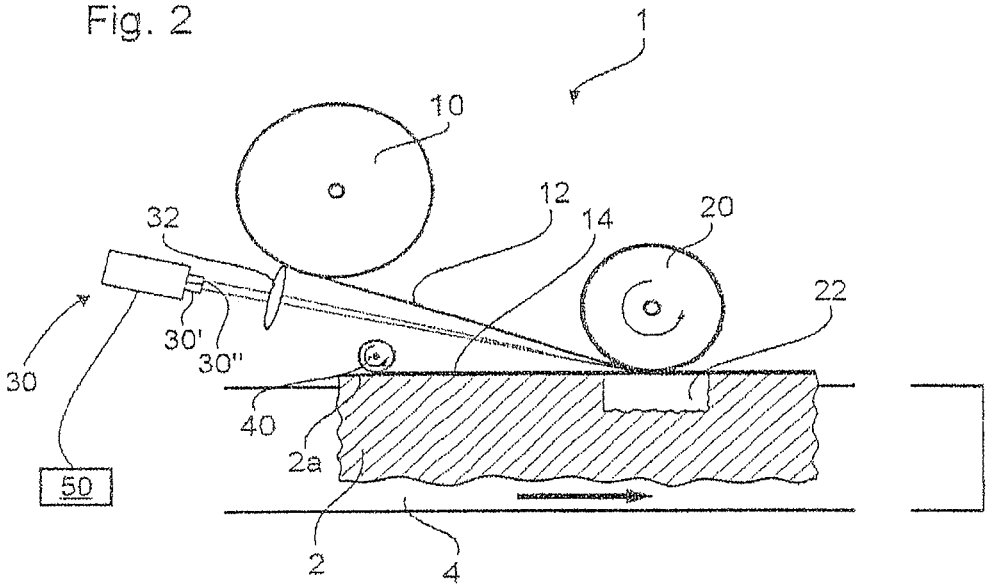
FIG. 2 shows schematically a top view of a coating device 1 as a second preferred embodiment of the present invention.

A second preferred embodiment of the coating device 1 according to the invention is shown schematically in a top view in FIG. 2. This differs from the first embodiment shown in FIG. 1 primarily in that the adhesive agent or agent that can be rendered adhesive 14 is not fed together with the coating material 12 but is applied to the surface 2*a* of the workpiece 2 to be coated by means of a device for providing adhesive agent in the form of an adhesive agent applicator roll 40. Alternatively or in addition, it is of course likewise possible to apply the adhesive agent to the coating material 12 by means of the device 40 for providing adhesive agent.

The adhesive agent or agent that can be rendered adhesive 14 so applied is then likewise activated or produced by being subjected to energy by means of the energy source 30, again immediately upstream of a pressing region 22.

Although not shown in FIG. 2, the coating device 1 according to the invention can of course also have further devices for providing adhesive agent, such as, for example, a second adhesive agent applicator roll, a feed device for an adhesive strip or the like, these different devices for providing adhesive agent preferably also providing adhesive agents or agents that can be rendered adhesive 14 that are different from one another. On the one hand, it is thereby possible to achieve particular effects on a single workpiece; on the other hand, it is likewise possible, as required, to use the different devices for providing adhesive agent alternately in the case of different workpieces and boundary conditions.

The second embodiment shown in FIG. 2 is additionally distinguished in that the energy generating sections 30' and 30" are integrated in a common laser device (energy source) 30. In this case they are so-called "laser bars", which are integrated in one laser but can be operated with different (and optionally also the same) operating parameters. Accordingly, the same effects can be achieved with the embodiment shown in FIG. 2 as have been described above in relation to the embodiment shown in FIG. 1. Instead of "laser bars", energy generating sections of a different type (which in turn can be of the same type or different from one another) can be integrated in a common device unit. This results in a simplified construction of the device according to the invention as a whole.

The operation of the embodiments of the device according to the invention described with reference to FIGS. 1 and 2 is described by way of example below with reference to FIG. 3 and FIG. 4. Both figures show a side view of a coating material 12, and the regions of the coating material in which the coating material is subjected to energy of an energy generating section 30' or 30" are marked schematically.

Figure 3:
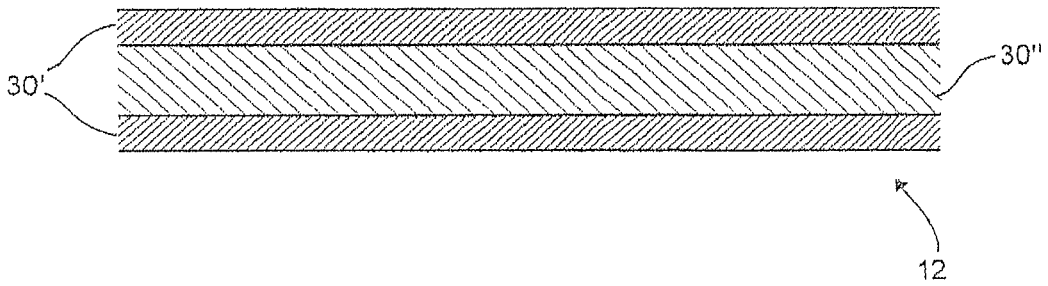
FIG. 3 shows schematically a view of the energy application patterns to a coating material.

Accordingly, it will be seen in FIG. 3 that the edge regions of the coating material 12 are subjected to energy of the energy generating section 30', while the core region of the coating material 12 is subjected to energy of the energy generating section 30". Alternatively, it is likewise possible for the entire surface of the coating material 12 to be subjected to energy from the energy generating section 30", so that there is an overlap in the region subjected to the energy from the energy generating section 30'. In those regions, the above-described particular effects of the utilization of different operating parameters are particularly marked. The extent of the overlap can also be varied in the course of a relative movement between the energy source and the coating material.

Figure 4:
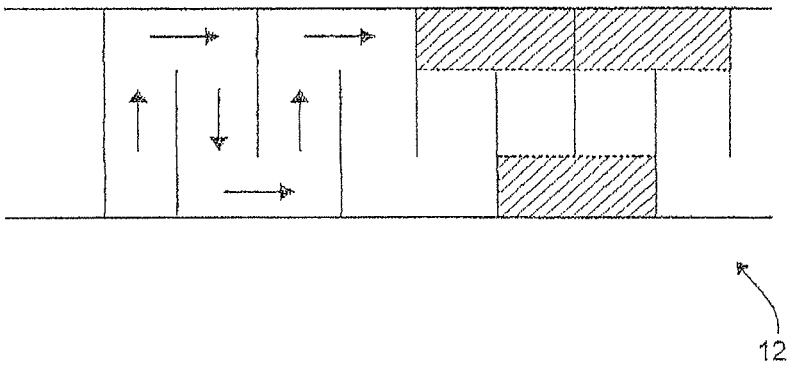
FIG. 4 shows schematically a view of further possible energy application patterns to a coating material.

In the embodiment shown schematically in FIG. 4, the application of energy to the coating material takes place along a square-sinusoidal path, the pattern of which is shown schematically by arrows. Several energy generating sections can follow this path, or only one energy generating section can follow this path, while other energy generating sections subject the coating material to energy over the whole surface or part of the surface.

In the course of the square-sinusoidal pattern, the operating parameters of one or more energy generating sections can purposively be varied, for example in the hatched edge regions of the coating material 12. In these hatched edge regions, it is possible, for example, for the rate of feed to be reduced, the power of the energy source (e.g. laser power) to be increased, or for specific energy generating sections to be switched on and off. In this manner, the quality of the join in different regions of the coating material can purposively be influenced so that an optimum combination of strength of the join and visual appearance of the join can be achieved.

In addition, within the context of the invention, it is also advantageously possible to carry out an adaptation to changing dimensions of the workpieces or coating materials by switching on or off one or more energy generating sections.

The invention claimed is:

1. A method for coating at least sections of a first and second workpiece selected from the group consisting of wood, wood-based materials, and plastics material using a coating device comprising, wherein the coating device comprises a supply of different coating materials including a first and second coating material, feeding the first coating material using a feed device, which is an element of the coating device, controlling at least the energy source, using a control device of the coating device, applying energy to the first coating material and/or to the first workpiece, using an energy section of an energy source of the coating device, wherein the energy source comprises at least two energy generating sections, and wherein, the control device operates at least the two energy generating sections wherein the at least two energy generating sections are different types of energy generating sections, pressing the first coating material onto a surface of the first workpiece using a pressing device of the coating device, bringing about a relative movement between the pressing device and the first workpiece using a conveyer device of the coating device, switching on or off one or more energy generating sections, feeding the second coating material using the feed device, applying energy to the second coating material and/or to the second workpiece, using the active energy generating section, pressing the second coating material onto a surface of the second workpiece using the pressing device of the coating device, bringing about a relative movement between the pressing device and the second workpiece using the conveyer device of the coating device.

2. The method according to claim 1, characterized in that at least one operating parameter is changed in the course of the relative movement between the energy source and the coating material or the workpiece.

3. The method according to claim 1, further comprising measuring an amount of energy applied by the energy source to the coating material and/or to the workpiece by use of a measuring device, wherein at least one operating parameter of the at least two energy generating section is fixed taking into account the measured amount of energy.

4. The method according to claim 1, characterized in that the at least one energy generating section is chosen from the group consisting of laser generating section, infra-red generating section, ultrasound generating section, magnetic field generating section, microwave generating section, plasma generating section and gassing section.

5. The method according to claim 1, characterized in that the operating parameters which can be set independently of one another are chosen from the group consisting of energy intensity, energy direction and energy generation pattern over time.

6. The method according to claim 1, characterized in that the control device operates at least two laser generating sections with different laser powers and/or laser wavelengths.

7. The method according to claim 1, characterized in that the at least two energy generating sections are arranged so that the applying of energy to the coating material and/or to the workpiece overlaps in sections.

8. The method according to claim 1, characterized in that the control device changes at least one operating parameter in the course of the relative movement between the energy source and the coating material or the workpiece.

9. The method according to claim 1, further comprises measuring the amount of energy applied to the coating material and/or to the workpiece by the energy source using a measuring device.

10. The method of claim 9 wherein the measuring device comprises a pyrometer.

11. The method of claim 1 characterized in that at least one of the operating parameters which can be set independently comprises measuring the time at which the energy generating section is switched on or off.

* * * * *